US005703322A

United States Patent [19]

Tidman

[11] Patent Number: 5,703,322

[45] Date of Patent: Dec. 30, 1997

[54] CARTRIDGE HAVING HIGH PRESSURE LIGHT GAS

[75] Inventor: Derek A. Tidman, McLean, Va.

[73] Assignee: General Dynamics Land Systems Inc., Sterling Heights, Mich.

[21] Appl. No.: 382,704

[22] Filed: Feb. 2, 1995

[51] Int. Cl.[6] ..... F42B 5/02

[52] U.S. Cl. ..... 102/440; 102/430; 102/443; 89/8

[58] Field of Search ..... 89/7, 8; 102/430, 102/440, 443, 705

[56] References Cited

U.S. PATENT DOCUMENTS

| | | | |
|---|---|---|---|
| H927 | 6/1991 | Miller | 102/440 |
| 2,129,875 | 9/1938 | Rost | 89/7 |
| 3,253,511 | 5/1966 | Zwicky | 89/8 |
| 3,630,151 | 12/1971 | Rakowsky | 89/7 |
| 3,916,761 | 11/1975 | Fletcher et al. | 89/8 |
| 3,939,816 | 2/1976 | Espy | 124/11 R |
| 3,996,916 | 12/1976 | Koehn et al. | 124/72 |
| 4,047,465 | 9/1977 | Wohlford | 89/8 |
| 4,077,349 | 3/1978 | Paul | 114/230 |
| 4,099,445 | 7/1978 | Singelmann et al. | 89/7 |
| 4,100,836 | 7/1978 | Hofmann | 89/7 |
| 4,336,741 | 6/1982 | Baines | 89/7 |
| 4,433,607 | 2/1984 | Kemeny | 89/8 |
| 4,658,699 | 4/1987 | Dahm | 89/8 |
| 4,711,154 | 12/1987 | Chryssomallis et al. | 89/7 |
| 4,722,261 | 2/1988 | Titus | 89/7 |
| 4,726,279 | 2/1988 | Kepler et al. | 89/8 |
| 4,932,306 | 6/1990 | Rom | 89/8 |
| 4,974,487 | 12/1990 | Goldstein et al. | 89/7 |
| 4,982,647 | 1/1991 | Hertzberg et al. | 89/8 |
| 5,012,719 | 5/1991 | Goldstein et al. | 89/8 |
| 5,063,826 | 11/1991 | Bulman | 89/8 |
| 5,078,117 | 1/1992 | Cover | 102/440 |
| 5,121,670 | 6/1992 | Fisher | 89/7 |
| 5,131,313 | 7/1992 | Zimmerman | 89/7 |
| 5,149,907 | 9/1992 | Thiesen | 89/7 |
| 5,303,553 | 4/1994 | Ollivaud et al. | 89/8 |
| 5,429,030 | 7/1995 | Tidman | 102/440 |

FOREIGN PATENT DOCUMENTS

| | | | |
|---|---|---|---|
| 365 | 1/1891 | United Kingdom | 102/440 |

OTHER PUBLICATIONS

Sutton, *Rocket Propulsion Elements*, John Wiley & Sons, 6th Edition (1992), p. 266.

Lord, *Performance of a 40 MM Combustion–Heated Light Gas Gun Launcher*, AEDC–TN–60–176, Oct. 1960.

*Primary Examiner*—Harold J. Tudor

*Attorney, Agent, or Firm*—Lowe, Price, LeBlanc & Becker

[57] ABSTRACT

A cartridge for accelerating a projectile includes a light gas pressurized in a sealed container to 5,000–10,000 psi. Upon ignition in the sealed container, a gas mixture having a low or intermediate molecular weight and a high or low energy density is applied as a high sound speed gas to accelerate the projectile to speeds of above about 2.4 km/sec.

41 Claims, 3 Drawing Sheets

CARTRIDGE HAVING HIGH PRESSURE LIGHT GAS

This invention is licensed to the United States of America for governmental purposes, pursuant to contract DASG60-89-C-0117 with the Department of the Army.

FIELD OF INVENTION

The present invention relates generally to cartridges for propelling projectiles and more particularly to a cartridge including both a solid propellant and light high-pressure combustible fluid or high pressure light fluids that become combustible on mixing.

BACKGROUND ART

It is desirable to propel projectiles to high speed by gases having low or intermediate molecular weights, such that the molecular weight of the propelling gas is no more than approximately 18; low and intermediate molecular weight gases respectively have maximum molecular weights of about 12 and 18 and gases of molecular weight below about 12 are frequently referred to as light gases. Typically, the light gas includes a significant percentage of hydrogen and/or helium, with the latter being preferred because it has low volatility and is inert. U.S. Pat. Nos. 4,974,487 and 5,012,719 disclose the use and/or generation of light gases to propel projectiles to high speed by providing cartridges including chemical components requiring an exothermal reaction to produce free hydrogen. Typically, this prior art approach has required substantial electrical energy, in quantities which are not easily achieved in portable military equipment, such as tanks and other motorized vehicles.

Another approach to provide a light gas to propel a projectile to high speed involves supplying high pressure gas from a pressurized source external to a gun to a chamber at a breech of the gun. This approach is also not feasible in many battlefield situations because of the necessity to carry large volumes of high pressure gas on a military vehicle. One specific prior art device using high pressure external sources is reported by M. E. Lord in a paper entitled *Performance of a 40 MM Combustion-Heated Light Gas Gun Launcher*, AEDC-TN-60-176, October 1960. In this device, hydrogen and a mixture of high pressure helium and oxygen are supplied from external sources to a reaction chamber at the gun breech. The constituents are maintained at high pressure for a short time in the chamber until the gas pressure is increased by ignition, which ruptures a diaphragm resulting in release of the high pressure gas against the base of a projectile which is then accelerated along a gun barrel. It is my understanding that unreliable results occur when this technique is scaled to large guns, capable of handling 120 mm projectiles.

An object of the present invention is to provide a new and improved cartridge for supplying a light gas to drive a projectile to a relatively high speed.

An additional object of the invention is to provide a cartridge having a high pressure light gas stored therein.

Another object of the present invention is to provide a new and improved cartridge including a stored pressurized light gas and a large projectile (e.g. 120 mm), wherein the projectile can be accelerated in a double-travel barrel to relatively high speeds, such as in the 2 to 3 km/sec. range.

An additional object of the invention is to provide a new and improved highly portable cartridge that can be used with mobile military field equipment and includes a relatively large projectile that is accelerated to high velocity by a light gas pulse that is generated without the need for external high pressure sources or high energy electrical power supplies.

A further object of the invention is to provide a new and improved cartridge including a pressurized light gas and a fuel gas, both of which are arranged for safe use and handling.

An additional object is to provide a new and improved cartridge including a low energy density, low molecular weight mixture of gases maintained at pressures between approximately 5,000–10,000 psi.

A further object is to provide a new and improved cartridge including high pressure gases that are mixed to form a high energy density low molecular weight gas for accelerating a projectile.

An added object is to provide a pump tube that is to be loaded into a cartridge and includes a high pressure gas that is compressed in response to ignition.

SUMMARY OF THE INVENTION

In accordance with one aspect of the invention, a housing of a cartridge carrying a projectile includes a sealed container means including: a mixture of an oxidizer gas and helium gas at a pressure of at least several hundred atmospheres, and a fuel having molecules including hydrogen atoms and a solid propellant. The sealed container means includes a front wall means between the remainder of the contents of the sealed container means and the projectile. The propellant, fuel, oxidizer gas, helium gas, sealed container means and front wall means are positioned, arranged and have constituents so that in response to ignition within the sealed container the propellant, fuel, light gas and oxidizer gas are combusted and mixed to increase the pressure on the front wall means to a sufficiently high value to burst the front wall means. Thereby, a light gas mixture including the fuel, light gas and oxygen having a pressure substantially higher than the pressure of the mixture in the sealed container means is applied to the projectile to accelerate the projectile in a barrel in which the projectile is located.

In certain embodiments, the sealed container means includes the solid propellant as well as piston means positioned between the propellant and gas in a forward portion of the sealed container means. The propellant when ignited generates gas behind the piston means to drive the piston means forward, thereby to increase the pressure on the gas in the forward portion of the sealed container means and cause high pressure, high sound speed gas initially in the sealed container means to be supplied to the projectile considerably prior to gas resulting from combustion of the solid propellant into gases having a higher molecular weight than the light combusting gases. Thereby, the high sound speed gas of the sealed container means, having a low molecular weight, is the primary accelerating agent acting on the base of the projectile. The higher molecular weight components of the solid propellant which is converted into an ignited gas have a lower sound speed than the high sound speed gas. The lower sound speed gas trails the high sound speed gas and acts as a piston against the high sound speed gas to assist in accelerating the high sound speed gas and the projectile to speeds of 2.4 kms/sec. or greater.

In one embodiment, the gas in the mixture in the sealed container means has a relatively low energy density no greater than about 7 kilojoules/gram. In such a case, the sealed container means can include a single sealed container including a single piston which preferably includes longitudinally extending openings so the same gas is resident on both sides thereof. To enhance the ignition process, the solid propellant preferably comprises multiple rods surrounded by the gas in the sealed chamber and extending longitudinally of the barrel and the direction of gas flow through the ruptured front wall means.

According to a further embodiment, the sealed container means includes many nested sealed containers, some including helium and an oxidizer gas at pressures of at least several hundred atmospheres and others including fuel at pressures approximately equal to the pressures in the containers including helium and the oxidizer. The nested sealed containers and the propellant are positioned and arranged so ends of the sealed containers proximate the projectile and included in the front wall means are ruptured. Gas from the plural containers is mixed behind the projectile in response to increased gas pressure produced in the many sealed containers in response to ignition of the solid propellant at the back of the many sealed containers.

Preferably, the many sealed containers include therein the propellant and a piston of the type discussed supra. Each of the pistons is positioned between the propellant and gas in a forward portion of the particular sealed container. The propellant in the particular sealed container, when ignited, generates gas behind the piston in the particular sealed container to drive the piston in the particular sealed container forward and to increase the pressure of the gas in the forward portion of the particular sealed container. The helium and oxygen in the sealed containers, when mixed with the helium and fuel in adjacent containers, have mole fractions such that the resulting light gas mixture has a high energy density of about 10 kilojoules/gram. Because the high energy density helium and oxidizing agent are in separate containers from the containers for the fuel, high energy density structures can be more safely provided.

In accordance with another aspect of the invention, a housing for a cartridge carrying a projectile includes sealed container means including a first gas at a pressure of at least several hundred atmospheres and a fluid reactant sealed to a pressure of at least several atmospheres. The gas in the sealed container means includes at least 50% by mole fraction of hydrogen or helium to enable the gas which results from ignition in the cartridge and that is applied to a projectile to be considered a light gas. The sealed container means also includes a solid propellant. A diaphragm means is provided between the contents of the sealed container means and the projectile. The propellant, gas, fluid reactant, sealed container means and diaphragm means are positioned, arranged and have constituents so that in response to ignition of constituents in the container the gas and fluid reactant are mixed and combusted to increase the pressure on the diaphragm means to a sufficiently high value to burst the diaphragm means so there is formed a gas mixture including the gas and reactant in gaseous form. The gas mixture has a pressure substantially higher than the pressure of the mixture in the sealed container means and is applied to the projectile to accelerate the projectile in a barrel in which the projectile is located.

In a preferred embodiment, the gas and fluid reactant are respectively first and second gases, both having a pressure of at least several hundred atmospheres. It is to be understood, however, that the fluid reactant can also be a liquid at a pressure of many atmospheres, but less than a hundred atmospheres. In the latter case, the cartridge must be maintained at relatively low temperatures, e.g. considerably less than 0° C., to obviate the advantage of basically room or ambient temperature conditions for the cartridge when both gases are at pressures in excess of 100 atmospheres.

If both gases are in the same sealed containers, the gas mixture consists essentially of $n_1He+n_2O_2+X$, where $n_2$ is smaller than $n_1$ and X is a fuel having a molecular ratio at least sufficient to conserve all the oxygen. Under such conditions, the mixture has a low molecular weight and a low energy density. Preferably, the fuel, X, is selected from the group consisting of $H_2$ and $CH_4$, which respectively have low and intermediate molecular weights. In such a situation, the safety concerns associated with $H_2$ are to a great extent obviated because the $H_2$ is mixed with helium.

A third aspect of the invention relates to a pump tube to be placed in a gun cartridge. The pump tube includes a sealed elongated sealed container having a gas therein at a pressure in the range of between 5,000–10,000 psi. A solid propellant is in a rearward portion of the container and a piston is in a midportion of the container, forward of the solid propellant. The piston is arranged so it translates toward a forward end of the container in response to ignition of a constituent in the sealed container. The gases are on both sides of the piston. The container is arranged so the forward end thereof is ruptured in response to ignition of the propellant therein. The gas in the container is either a hydrocarbon fuel, preferably methane and possibly helium, or an oxidizer, preferably $He+\epsilon O_2$, where $\epsilon$ is greater than 0 and less than 1. The tube preferably has a cross section having straight sides, such that several of the tubes can be nested together with abutting sides. Thereby, when the tubes are nested together the gas does not rupture the side walls of the tube, but ruptures the front walls thereof, upon ignition of a constituent within a particular tube.

The above and still further objects, features and advantages of the present invention will become apparent upon consideration of the following detailed description of specific embodiments thereof, especially when taken in conjunction with the accompanying drawings.

DESCRIPTION OF THE PREFERRED EMBODIMENTS

Figure 1:
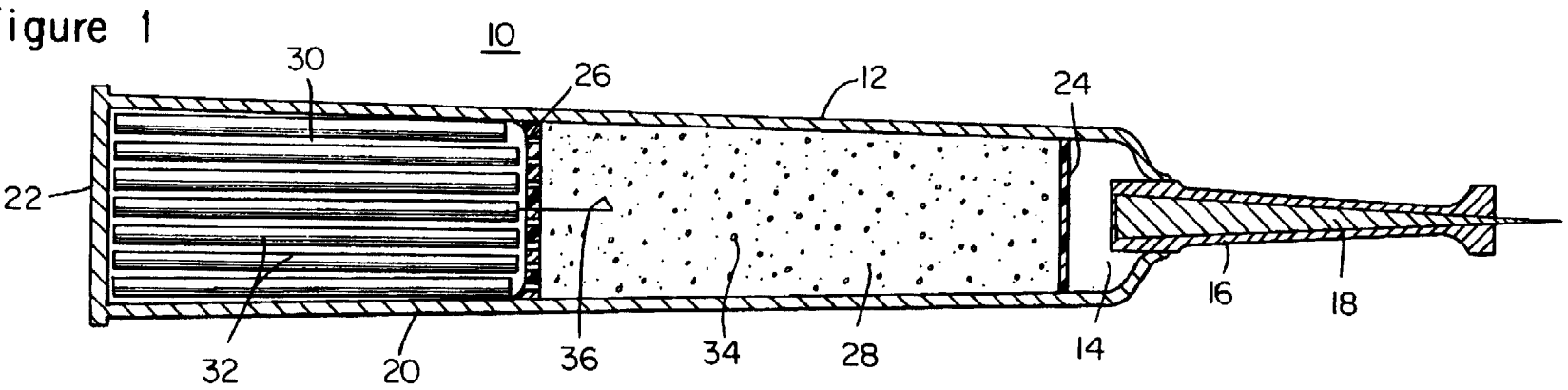
FIG. 1 is a side sectional view of a first embodiment of a cartridge in accordance with the present invention wherein the cartridge includes a high pressure, low energy density mixture of helium and oxygen and fuel gas in a single sealed container.

Reference is now made to FIG. 1 of the drawing, a side sectional view of a cartridge adapted to be loaded into a conventional gun, such as a 120 mm tank gun. Cartridge 10 includes sealed, steel container 12, behind frustoconical intermediate region 14, to which is attached sabot 16, carrying projectile 18. Sealed container 12 includes cylindrical and slightly tapered side wall 20, back plate 22 and forward diaphragm 24. Perforated piston 26, made of a relatively light plastic material, is seated on wall 20, at an intermediate point between back wall 22 and diaphragm 24 to divide chamber 12 into forward volume 28 and rear volume 30. Rear volume 30 includes numerous elongated solid propellant rods 32 extending longitudinally between back plate 22 and piston 26; rods 32 are made of a conventional solid propellant material, such as JA2, a high energy, low molecular weight gun propellant.

A low energy density (i.e., no more than about 7 kilojoules per gram), low molecular weight (i.e., between 2 and about 12) combustible gas 34 including a fuel component (e.g., the gas can be a mixture of oxygen, helium and methane gases) is maintained at high pressure, in the range of at least about 5,000 psi to 10,000 psi. Gas 34 is stored in sealed container 12 located in the otherwise empty portions of forward and rear volumes 28 and 30. To maintain gas 34 in container 12, wall 20 and back plate 22 are capable of withstanding pressures in excess of 10,000 psi, while diaphragm 24 has a rupture pressure about 4,000 psi greater than the pressure of the gas in the sealed container.

To ignite the low energy density low molecular weight gas 34 in chamber 12, conventional electrical ignitor squib 36 extends through piston 26 into gas 34 in forward volume 28. Squib 36 is energized by a conventional, relatively low energy electrical power supply (not shown), capable of delivering about the same energy as is necessary to fire a spark plug.

Figure 2:
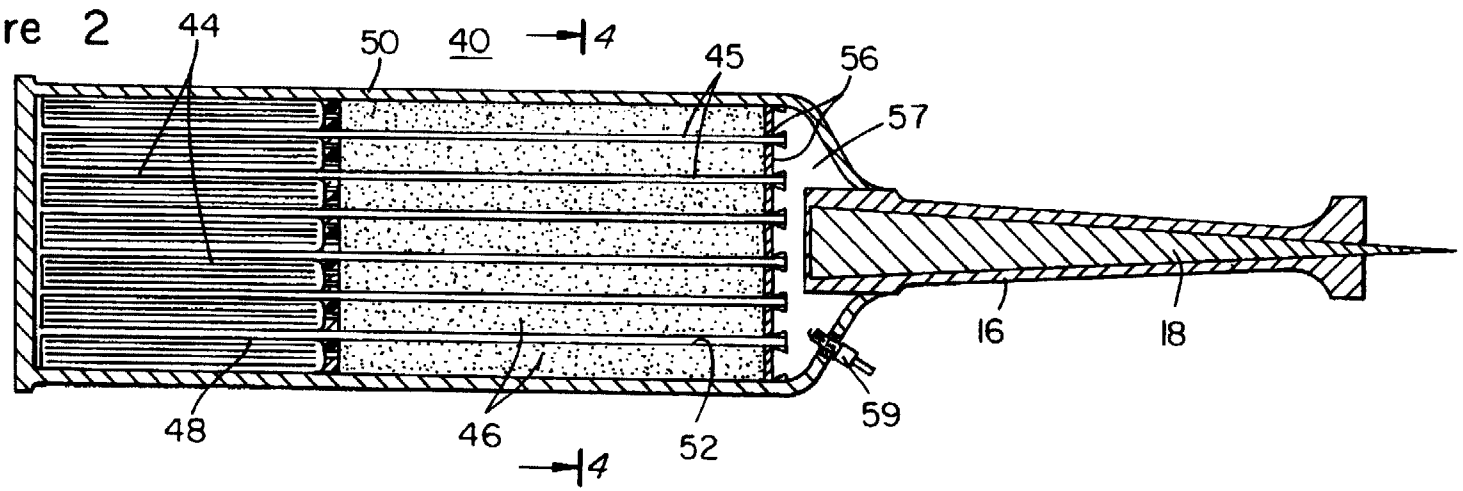
FIG. 2 is a side sectional view of a cartridge in accordance with a second embodiment of the invention wherein the cartridge includes at least several individual nested containers, some including high pressure, high energy density gas mixture of helium and oxygen and others including high pressure gaseous fuel.
Figure 3:
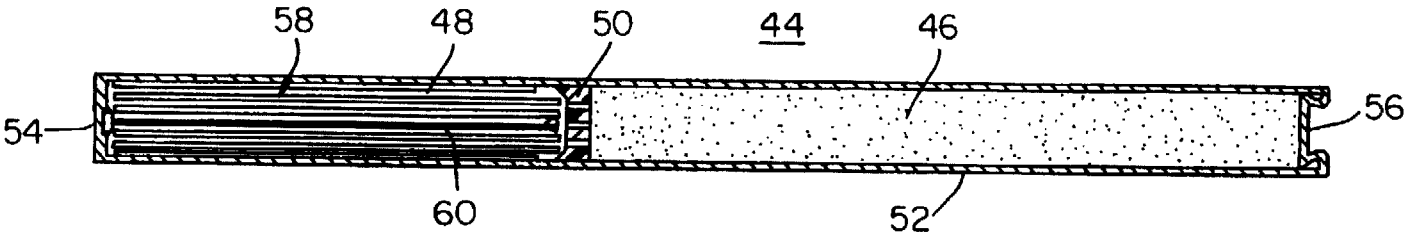
FIG. 3 is an enlarged view of one sealed chamber employed in the embodiment of FIG. 2.
Figure 4:
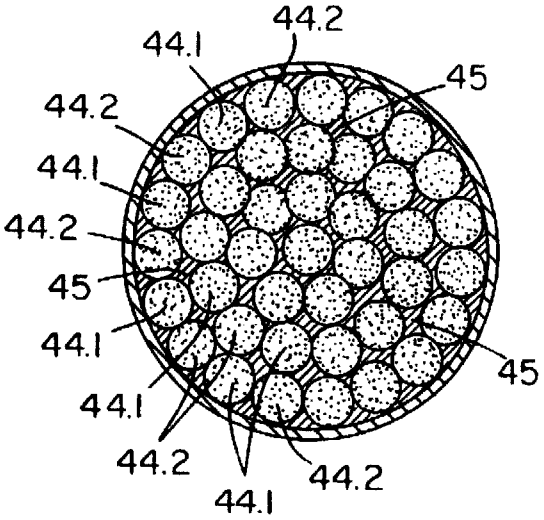
FIG. 4 is a transverse cross sectional view, taken through line 4—4, FIG. 2.

A second embodiment of the invention, illustrated in FIGS. 2–4, includes cartridge 40 in which are nested many sealed pump tubes 44 where high pressure fuel gas and a mixture of helium and oxygen gas from many of tubes 44 are mixed to produce a high energy density (i.e., between about 7–12 kilojoules per gram) low molecular weight gas that drives projectile 18. Hence, the embodiment of FIG. 2 differs from FIG. 1 because the projectile driving gas of FIG. 2 has a high energy density rather than the lower energy density projectile driving gas as in the embodiment of FIG. 1.

In the embodiment of FIG. 2 and as illustrated in FIG. 3, each of steel pump tubes 44 includes forward region 46, rear region 48 and perforated, lightweight plastic piston 50 which separates the forward and rear volumes. Each of tubes 44 includes cylindrical wall 52 (to which piston 50 is initially attached), a rear plate 54, a front wall 56 and is loaded with a gas having a pressure in the range of between about 5,000–10,000 psi, preferably maintained at ambient temperature prior to ignition. Front wall 56 has a rupture pressure approximately a few thousand psi more than the normal 5,000–10,000 psi pressure of the gas in the pump tube, under ambient, non-ignited conditions. In addition, within each of pump tubes 44 are multiple solid propellant rods 58 that extend between back plate 54 of the tube and piston 50 within the tube. Each of tubes 44 also includes a conventional electrical ignitor or squib 60 that projects into rearward region 48 and is connected via a suitable electric wire extending through rear region 48 and back plate 54 to a conventional relatively low power electric supply.

The gas in approximately half of tubes 44, i.e., tubes 44.1, is a light gas including an oxidizer, such as $He+\epsilon O_2$, where $\epsilon$ is a number having a value greater than 0 and less than 1. The high pressure gas in the remaining tubes 44, i.e., tubes 44.2, is a mixture of fuel gas such as methane ($CH_4$) or hydrogen with helium. Pump tubes 44.1 containing high pressure oxidizer gas and pump tubes 44.2 containing high pressure fuel gas are nested with each other in alternate fashion, so that generally each of pump tubes 44.1 is next to a pump tube 44.2 to enhance mixing of the gases in the two different types of pump tubes in forward chamber 57 where the mixture is ignited electrically by spark plug 59 or via self-igniting platinum mesh in the forward chamber. If spark plug 59 is used it is energized by a high voltage in synchronism with activation of ignitor 60.

Figure 5:
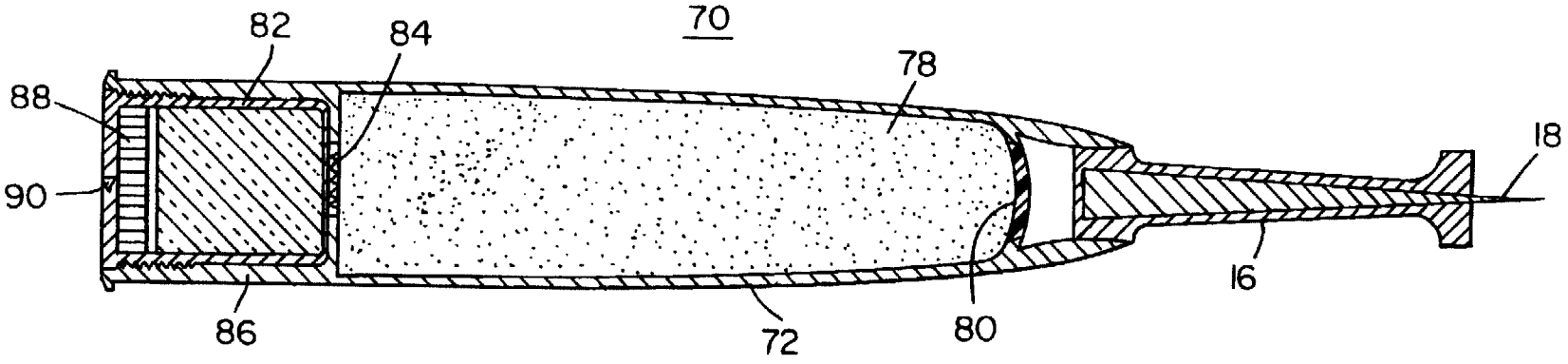
FIG. 5 is a side sectional view of another embodiment wherein high pressure, low atomic weight gas is loaded in a first sealed container and another constituent of a gas that accelerates a projectile of the cartridge is in a second sealed container.

In a further embodiment of the invention, illustrated in FIG. 5, cartridge 70 includes housing 72 carrying sabot 16 and projectile 18 at the forward end thereof. Almost immediately behind sabot 16 is sealed container 78, filled with a high pressure (e.g., about 5,000–10,000 psi) gas maintained at ambient temperature, such as 300° K. Between the forward wall of container 78 and the base of sabot 74 is frangible diaphragm 80, which is ruptured in response to the pressure at the front wall of container 78 exceeding the pressure normally maintained therein by a predetermined amount, e.g. about 1 kilobar.

Housing 72 includes a second sealed container 82 that functions as an injector cartridge and is located behind container 78. Container 82 stores a gas or liquid, maintained at a pressure comparable to the pressure of the gas within container 78. Container 82 includes nozzles 84 at the forward end thereof, in juxtaposition with the back face of container 78. Positioned within container 78, next to the rear wall of the container, are elongated solid propellant rods 88, electrically connected to relatively low power electrical ignitor 90.

In one embodiment, container 78 is filled with a high pressure (in the range of between about 5,000–10,000 psi) oxidizing agent, preferably a mixture of helium and oxygen. The mole fraction of oxygen to helium is such that the mixture in container 78 has a low energy density after being mixed with fuel jets flowing from container 82 into container 78. The chemical mixture initially in container 78 is represented by $He+\epsilon O_2$, where $\epsilon$ has a value that is sufficiently low to form a low energy density, low molecule weight gas mixture that results from the interaction of the jets from container 82 and that accelerates sabot 16 and projectile 18. In this preferred embodiment, the mass 86 in container 82 is a hydrocarbon fuel.

Methane is the hydrocarbon fuel having the highest performance for mass 86, as well as for the gaseous fuel in the embodiments of FIG. 1 and FIGS. 2–4, because it has low molecular weight and can be stored under pressure as a gas at normal temperature in container 82. For example, methane at a pressure of 10,000 psi at a temperature of 300° K. has 70% of its boiling point liquid density. It is also possible to store methane in container 82 in liquid form at reduced pressure. For example, methane could be stored in a refrigerated dewar at a temperature of −82.1° C. and pressure of 45.8 bars. It is an engineering decision as to whether the refrigeration for cartridge 70 is advisable for storing the methane at relatively low pressure compared to storing room temperature methane at a pressure in the neighborhood of between about 700–1400 bars. While many higher molecular weight hydrocarbons can be used and stored as liquids at normal temperatures, such hydrocarbons have reduced performance compared to methane because of the increased fraction of carbon dioxide in the resulting combustion products.

In accordance with a further arrangement of the embodiment of FIG. 5, if a very high velocity is required, hydrogen or a mixture of hydrogen and helium is stored in container 78 at a pressure in the 5,000–10,000 psi range. In such a situation, oxygen gas is stored in canister 82 at a pressure in the same range as the pressure in container 78. In such an instance, hot propelling gas flowing through burst diaphragm 80 against sabot 74 to accelerate projectile 76 would primarily consist of hydrogen plus some steam, e.g., $H_2+H_2O$. Because this gaseous mixture has a lower average molecular weight than the mixture which results from canister 82 storing methane and container 78 storing hydrogen and helium, acceleration of projectile 18 to velocities about 3 km/second becomes possible.

In the embodiments of FIG. 1 and FIGS. 2–4, a given fluid mass, M, is stored at a relatively high pressure, P. In the embodiment of FIG. 1, mass M is stored in a single large container, while in the embodiment of FIGS. 2–4, virtually the same mass is stored in virtually the same volume by many small containers, each having a pressure of P. The mass of the storage containers in each of the embodiments is approximately the same so there is no mass penalty in using prefilled cartridges as the gas containers. The wall thickness needed to contain a given gas pressure is proportional to the diameter of the cylindrical container holding the mass, with spherical end caps. By prefilling a high pressure gas in either a single large container, as in the embodiment of FIGS. 1 and 5, or many small containers, as in the embodiment of FIGS. 2–4, the need for a pumping system as part of a gun is obviated. The containers are preloaded at a local depot or in a factory where the cartridges are made.

The energy density of readily contained gas fills, as in the embodiments of FIGS. 1 and 2, is less than that of a solid propellant. Hence, gas-filled cartridges must be larger than conventional solid propellant cartridges. To minimize cartridge size, high energy density, light gas mixtures are used with high energy density solid propellants in the cartridges, as in the embodiments of FIGS. 2–4 and 5. The embodiments of FIGS. 1 and 2 avoid large pressure fluctuations involving the use of fast burning, high energy density gas mixtures ignited after injection of the gas into a large bore chamber.

In the embodiment of FIG. 1, the energy density of the high pressure gas is sufficiently low to prevent deleterious detonation waves from occurring in large bore guns. In addition, the energy density of the gas in the single container is sufficiently low to enable the cartridge to be safe for handling.

The embodiment of FIGS. 2–4 has the advantage of enabling a high energy density gas to be stored in containers 44.1. Because the high energy density gas in containers 44.1 is physically spaced from the fuel gas in containers 44.2, the cartridge is safe for handling. In addition, a pinhole leak in one of tubes 44.1 or 44.2 does not have the deleterious effects that a pinhole leak has in the container of FIG. 1. The pump tubes of the embodiment of FIGS. 2–4, which can be manufactured easily in large numbers, form building blocks for various cartridge geometries.

As pointed out above, there is no substantial mass penalty resulting from storage of the gases in many narrow tubes 44.1 and 44.2 instead of the single large diameter tube of FIG. 1, because the wall thickness required to contain the gases in tubes 44.1 and 44.2 is proportional to the tube diameter. The side walls of tubes 44, together, have a mass about equal to that of the side wall of sealed container 12 in the embodiment of FIG. 1. Filler 45 in voids between neighboring tubes 44.1 and 44.2 support the walls of these tubes after ignition and add a small mass to the cartridge. To maximize the amount of gas filled in tubes 44.1 and 44.2, the tubes preferably are nested together and have abutting surfaces as a result of the tubes having triangular or hexagonal cross sections; such a structure obviates the need for filler 45.

In the embodiment of FIGS. 2–4, the oxidizer and fuel gases in container tubes 44.1 and 44.2 are metered at an appropriate rate through front face 56 of each tube into forward chamber 57 as projectile 18 accelerates. The solid propellant rods 48 in all of tubes 44.1 and 44.2 are simultaneously ignited. The arrangement in the embodiment of FIGS. 2–4 thus avoids the requirement to ignite a large premixed gas fuel volume and prevents excessive combustion-driven over pressure fluctuations or waves within the cartridge or chamber 57 or the gun barrel, to provide a smooth, continuous application of high pressure, relatively low temperature gas (maximum temperature of approximately 2,000° C. in a combustion state), to sabot 16, projectile 18 and down the gun barrel along which they propagate. If the gases were completely mixed before ignition, there is a high probability of over pressure waves.

In the embodiment of FIGS. 2–4, very efficient combustion occurs because of turbulent mixing in chamber 57 between front walls 56 of tubes 44.1 and 44.2 and projectile 18. The turbulent mixing occurs from the jets injected into chamber 57 via ruptured front walls 56, even though the residence time of molecules in chamber 57 is typically less than 10 milliseconds. These results are provided with a large bore gun even though combustion continues for an extended distance along the gun barrel.

The thermal energy density of the gaseous non-ignitable oxidizer components in containers 44.1 at 10,000 psi is in the range of 0.15 to 0.2 kilojoules/cubic centimeter. The combustion energy in chamber 57 is about 2 to 3 kilojoules/cubic centimeter after the gases in tubes 44.1 and 44.2 have been ignited and mixed. Because of these factors, the effect of a rupture or leak of any one of tubes 44.1 or 44.2 would not be an energetic event. Similarly the solid propellant rods in each of tubes 44.1 and 44.2 are relatively small and therefore less dangerous than a single large propellant charge, as in the embodiment of FIG. 1.

In each of the aforementioned embodiments, a relatively high sound speed gas having a low molecular weight is applied to sabot 16 and projectile 18, to accelerate them to relatively high velocities, such as 2.4 km/sec. or more, through a gun barrel in which the projectile and sabot are initially positioned. The higher molecular weight constituents of the gasified solid propellants are not extensively mixed with the low molecular weight constituents in the gas mixture and thereby do not adversely affect projectile speed.

In the embodiments of FIG. 1 and FIGS. 2–4, the low molecular weight gases in front of plastic piston 26 or 50 are compressed by the piston being driven forward by the ignited solid propellant gases and the low molecular weight gases behind the piston. The relatively high sound speed gases in front of tubes 48 are accelerated by piston-like action produced by relatively high molecular weight gases resulting from ignition of the solid propellant. The plastic pistons, being lightweight structures, are forced through the gun barrel and exit the gun barrel from the muzzle thereof, in response to the high pressure gases resulting from ignition of the solid propellant. In the embodiment of FIG. 5, the fuel gas in canister 86 is injected by nozzles 84 into the gas in container 78 to form the low atomic weight gas that is then ignited by hot gases from solid propellant 88 to combust the low atomic weight gas which then acts on sabot 16 and projectile 18.

Exemplary prefill compositions for the embodiments of FIG. 1 and FIGS. 2–4 are listed below in tabular form.

| Prefill Composition | Prefill Pressure at 300K kpsi | Combustion Energy kJ/cm³ | Combustion Energy kJ/gm | Density gm/cm³ | Molecular Weight of combustion products assuming complete to $CO_2$ and $H_2O$ |
|---|---|---|---|---|---|
| He + 0.276 ($CH_4$ + $2O_2$) | 5 | 1.58 | 9.31 | 0.170 | 14.26 |
| | 10 | 2.76 | 9.31 | 0.296 | 14.26 |
| | 15 | 3.66 | 9.31 | 0.394 | 14.26 |
| | 20 | 4.38 | 9.31 | 0.471 | 14.26 |
| He + 0.172 ($CH_4$ + $2O_2$) | 5 | 1.18 | 8.52 | 0.138 | 11.7 |
| | 10 | 2.07 | 8.52 | 0.242 | 11.7 |
| | 15 | 2.76 | 8.52 | 0.323 | 11.7 |
| | 20 | 3.31 | 8.52 | 0.368 | 11.7 |
| He + 0.276 ($4H_2$ + $2O_2$) | 5 | 1.15 | 11.15 | 0.103 | 11.35 |
| | 10 | 1.96 | 11.15 | 0.175 | 11.35 |
| | 15 | 2.56 | 11.15 | 0.230 | 11.35 |
| | 20 | 3.03 | 11.15 | 0.272 | 11.35 |

While there have been described and illustrated several specific embodiments of the invention, it will be clear that variations in the details of the embodiments specifically illustrated and described may be made without departing from the true spirit and scope of the invention as defined in the appended claims.

I claim:

1. A cartridge comprising a housing carrying a projectile, the housing including:

a sealed container structure including: a mixture comprising an oxidizer gas and helium gas at a pressure of at least several hundred atmospheres, a fuel having molecules including hydrogen atoms, a solid propellant, a front wall structure confining a mass in the sealed container structure from the projectile; the propellant, fuel, oxidizer gas, helium gas, sealed container structure and front wall structure being positioned, arranged and including materials so that in response to ignition within the sealed container structure, the propellant, fuel, helium gas and oxygen from the oxidizer gas are further pressurized and mixed to increase the pressure on the front wall structure to a sufficiently high value to burst the front wall structure so a gas mixture including the fuel, helium gas and oxygen having a pressure substantially higher than the pressure of the mixture in the sealed container structure is applied to the projectile to accelerate the projectile in a barrel in which the projectile is located.

2. The cartridge of claim 1 wherein the sealed container structure includes the propellant and a piston means positioned between the propellant and gas in a forward portion of the sealed container structure, the propellant when ignited generating combusting gas behind the piston structure to drive the piston means forward and to increase the pressure on the combusting gas in the forward portion of the sealed container structure and cause high pressure gas initially in the sealed container structure to be supplied to the projectile considerably prior to gas resulting from combustion of the solid propellant.

3. The cartridge of claim 2 wherein the gas in the mixture in the sealed container structure has a relatively low energy density below about 7 kilojoules per gram.

4. The cartridge of claim 3 wherein the sealed container structure includes a single sealed container, and the piston means comprises a single piston having openings so the same mixture is resident on both sides of the piston.

5. The cartridge of claim 2 wherein the piston means includes openings so the gas is resident on both sides thereof.

6. The cartridge of claim 5 wherein the solid propellant comprises multiple rods surrounded by the gas in the sealed container structure.

7. The cartridge of claim 6 wherein the rods are elongated in a direction of gas flow through the ruptured diaphragm means.

8. The cartridge of claim 1 wherein the sealed container structure includes plural nested sealed containers, some including helium and an oxidizer gas at pressures of at least several hundred atmospheres and others including fuel at pressures approximately equal to the pressure in said some containers, the nested sealed containers and the propellant being positioned and arranged so ends of the sealed containers proximate the projectile and included in the front wall structure are ruptured and gas from the plural containers is mixed and ignited behind the projectile in response to increased gas pressure produced in the plural sealed containers in response to ignition of the propellant.

9. The cartridge of claim 8 wherein the sealed containers include the propellant therein.

10. The cartridge of claim 9 wherein the sealed containers include a piston therein, each of the pistons being positioned between the propellant and gas in a forward portion of the particular sealed container, the propellant in the particular sealed container when ignited generating gas behind the piston in the particular sealed container to drive the piston in the particular sealed container forward and to increase the pressure on the gas in the forward portion of the particular sealed container.

11. The cartridge of claim 10 wherein the pistons include openings so the same gas is resident on both sides of the pistons.

12. The cartridge of claim 8 wherein the helium and oxygen in said some sealed containers have mole fractions such that the resulting mixture has a relatively high energy density of about 10 kilojoules/gram when mixed and combusted with the fuel to combine with the oxygen.

13. The cartridge of claim 8 wherein each of the sealed containers includes the propellant therein.

14. The cartridge of claim 9 wherein each of the sealed containers includes a piston therein, each of the pistons being positioned between the propellant and gas in a forward portion of the particular sealed container, the propellant in the particular sealed container when ignited generating gas behind the piston in the particular sealed container to drive the piston in the particular sealed container forward and to increase the pressure on the gas in the forward portion of the particular sealed container.

15. A cartridge comprising a housing carrying a projectile, the housing including: a sealed container structure including a first gas at a pressure of at least several hundred atmospheres, a fluid reactant sealed to a pressure of at least several atmospheres, the gas including an oxidizer gas and at least 50% by mole fraction of helium, a solid propellant, a diaphragm structure confining the gas in the sealed container structure from the projectile, the propellant, gas, reactant, sealed container structure and diaphragm structure being positioned, arranged and having constituents so that in response to ignition of constituents in the sealed container structure the first gas and the reactant are mixed and further pressurized to increase the pressure on the diaphragm means to a sufficiently high value to burst the diaphragm structure so there is formed a light gas mixture including the gas and reactant in gaseous form having a molecular weight below about 12, the light gas mixture having a pressure substantially higher than the pressure of the mixture in the sealed container structure and being applied to the projectile to accelerate the projectile in a barrel in which the projectile is located.

16. The cartridge of claim 15 wherein the gas and reactant are respectively first and second gases, the second gas having a pressure of at least several hundred atmospheres.

17. The cartridge of claim 16 wherein the first and second gases are sealed in the same container and together form a gas mixture having a relatively low energy density in the range below about 7 kilojoules/gram and a relatively low molecular weight no higher than about 12.

18. The cartridge of claim 15 wherein the gases are at ambient temperature.

19. The cartridge of claim 17 wherein the gas mixture consists essentially of $n_1He+n_2O_2+O$, where $n_2$ is smaller than $n_1$ and O is a fuel in an amount sufficient to at least consume all the oxygen.

20. The cartridge of claim 19 wherein Q is selected from the group consisting essentially of $H_2$ and $CH_4$.

21. The cartridge of claim 17 wherein the container includes a piston positioned behind a forward portion of the container, gas behind the piston when ignited driving the piston forward to increase the pressure on gas in the forward portion of the sealed container.

22. The cartridge of claim 21 wherein the solid propellant is located in the container behind the piston.

23. The cartridge of claim 22 wherein the piston includes openings so the same gas is resident in the sealed container on both sides of the piston.

24. The cartridge of claim 23 wherein the propellant is elongated in the direction of gas flow through the diaphragm.

25. The cartridge of claim 16 wherein the first and second gases are sealed in different containers.

26. The cartridge of claim 25 wherein the oxidizer consists essentially of oxygen.

27. The cartridge of claim 25 wherein the second gas consists essentially of a fuel.

28. The cartridge of claim 27 wherein the fuel is a hydrocarbon.

29. The cartridge of claim 28 wherein the hydrocarbon fuel is methane.

30. The cartridge of claim 25 wherein a container including the first gas is in front of a container including the second gas.

31. The cartridge of claim 30 wherein the container including the second gas includes solid propellant rods behind at least a portion of the second gas.

32. The cartridge of claim 25 wherein many of the containers are nested together so containers including the first gas are next to containers including the second gas.

33. The cartridge of claim 32 wherein the gases in the many containers are arranged so the mixture has a high energy density between about 7–12 kilojoules per gram, and consists essentially of helium, oxygen and a hydrocarbon fuel component.

34. The cartridge of claim 33, wherein the hydrocarbon fuel is methane.

35. The cartridge of claim 33 wherein the first gas consists essentially of a mixture of helium and oxygen.

36. The cartridge of claim 35 wherein the second gas consists essentially of the fuel.

37. The cartridge of claim 32 wherein containers including the first and second gases include a piston positioned behind a forward portion of the container, gas behind the piston when ignited driving the piston forward to increase the pressure on gas in the forward portion of the sealed container.

38. The cartridge of claim 37 wherein the solid propellant is located in the containers behind the pistons.

39. The cartridge of claim 38 wherein each of the pistons includes openings so the same gas is resident in the sealed containers on both sides of the pistons.

40. The cartridge of claim 16 wherein the first and second gases are sealed in the same container.

41. The cartridge of claim 16 wherein all of the first and second gases are sealed in a single container.

* * * * *